United States Patent [19]

Schmidt et al.

[11] Patent Number: 4,932,932

[45] Date of Patent: Jun. 12, 1990

[54] METHOD OF AND APPARATUS FOR CUTTING BLANKS FROM AN ELASTIC PAPER

[75] Inventors: Heinrich Schmidt, Porta Westfalica; Edgar Besenreiter, Minden, both of Fed. Rep. of Germany

[73] Assignee: Melitta-Werke Bentz & Sohn, Minden, Fed. Rep. of Germany

[21] Appl. No.: 236,883

[22] Filed: Aug. 26, 1988

[30] Foreign Application Priority Data

Aug. 29, 1987 [DE] Fed. Rep. of Germany ..... 3728888

[51] Int. Cl.[5] ..... B26D 9/00; B26D 1/22

[52] U.S. Cl. ..... 493/200; 493/235; 83/14; 83/32; 83/37; 83/40; 83/55; 83/343; 83/408; 83/495

[58] Field of Search ..... 83/14, 32, 37, 40, 55, 83/343, 346, 495, 505, 508–511, 407, 408; 493/194, 196, 225, 235; 156/200, 207

[56] References Cited

U.S. PATENT DOCUMENTS

| | | | |
|---|---|---|---|
| 3,182,541 | 5/1965 | Nutting et al. | 83/346 |
| 3,257,885 | 6/1966 | Hornung | 83/346 |
| 3,372,625 | 3/1968 | Simecek et al. | 493/194 |
| 3,866,500 | 2/1975 | Wolfberg et al. | 83/846 |
| 3,875,837 | 4/1975 | Dussaud | 83/408 |
| 3,956,049 | 5/1976 | Johnsen | 156/200 |
| 4,009,626 | 3/1977 | Gressman | 83/346 |
| 4,164,170 | 8/1979 | Nordin | 493/194 |
| 4,355,494 | 10/1982 | Tilman | 493/194 |

*Primary Examiner*—Frank T. Yost
*Assistant Examiner*—Scott A. Smith
*Attorney, Agent, or Firm*—Spencer & Frank

[57] ABSTRACT

A method of cutting blanks from an elastic paper comprises the following steps: removing a single elastic paper web of indefinite length from a mother roll; longitudinally cutting the single web, as it runs off the mother roll, into a plurality of paper panels; guiding the running paper panels in pairs into a superposed, face-to-face relationship to form at least one running superposed paper panel pair; guiding the running paper panel pair between cooperating cutting rollers of a rotary cutter and cutting the blanks from the running paper panel pair by the cutting rollers alternatingly from opposite sides of the paper panel pair while countersupporting the paper panel pair by the momentarily non-cutting cutting roller.

8 Claims, 4 Drawing Sheets

METHOD OF AND APPARATUS FOR CUTTING BLANKS FROM AN ELASTIC PAPER

BACKGROUND OF THE INVENTION

The present invention relates to a method of and an apparatus for cutting blanks from an elastic paper, for example crepe paper, in which paper sheets pulled from a roll are brought together to lie on top of one another in pairs. The blanks are then cut out in a rotary cutter which includes two rollers.

The manufacturing of blanks from superposed paper panels by jointly cutting out the blanks within a rotary cutter using two rollers is known. Typically, the prior art rotary cutters always include a cutting roller and a counterface without cutting blades so that the respective cut is always performed from one side of the superposed paper panels.

If papers are processed which have extremely low elasticity, this method can be implemented without problems. If, however, an elastic paper is employed, for example crepe paper which has a relatively high elasticity, panel tension problems arise. Specifically, the paper panel which is cut first is temporarily subjected to less tension than the paper panel lying against the counterface.

In order to be able to compensate for the differences in panel tension created in this way, the prior art method and cutting device could only be employed if the paper was taken from two separate rolls. This allows the rolls to be braked independently of one another and thus compensate for the difference in tension.

SUMMARY OF THE INVENTION

It is an object of the present invention to develop a method of and apparatus for cutting blanks from an elastic paper in which the panel tension problems encountered in the prior art are avoided in a simple way and which, as a whole, permits extremely economical production of blanks.

This object and others to become apparent as the specification progresses, are accomplished by the invention, according to which, briefly stated, the method of cutting blanks from an elastic paper comprises the following steps: removing a single elastic paper web of indefinite length from a mother roll; longitudinally cutting the single web, as it runs off the mother roll, into a plurality of paper panels; guiding the running paper panels in pairs into a superposed, face-to-face relationship to form at least one running superposed paper panel pair; guiding the running paper panel pair between cooperating cutting rollers of a rotary cutter and cutting the blanks from the running paper panel pair by the cutting rollers alternatingly from opposite sides of the paper panel pair while countersupporting the paper panel pair by the momentarily non-cutting cutting roller.

By alternatingly cutting the superposed paper panels there is achieved a tension equalization between the two paper panels by virtue of alternating tension changes. Thus, the unlike panel tensions and resulting crinkling as well as a wandering of the paper panels characterizing the prior art devices are excluded. The alternating cutting, in turn, is a prerequisite for working from a single mother roll (supply roll) in an economical manner since it is not possible to differently brake individual paper panels when the operation involves a single mother roll.

Furthermore, the use of only a single mother roll is of advantage in every respect, not the least because only one holder is required for the mother roll.

A device according to the invention for implementing the method and including a roll holder and a rotary cutter composed of two rollers which are configured as transporting rollers at least over part of their circumference is characterized in that both rollers are provided with cutting blades. The cutting blades are offset with respect to one another when viewed in the circumferential direction. The rollers are configured, in the respective regions not equipped with cutting blades, as counterrollers for the regions of the respectively other roller where it is equipped with a cutting blade. Stated differently, when one blade is cutting, the other blade acts as a counter-supporting roller.

A rotary cutter configured in this manner in a corresponding device permits, on the one hand, proper transport of the two superposed paper panels and, on the other hand, the likewise proper alternating cutting of the superposed paper panels which leads to compensation of tension.

DESCRIPTION OF THE PREFERRED EMBODIMENTS

Figure 1:
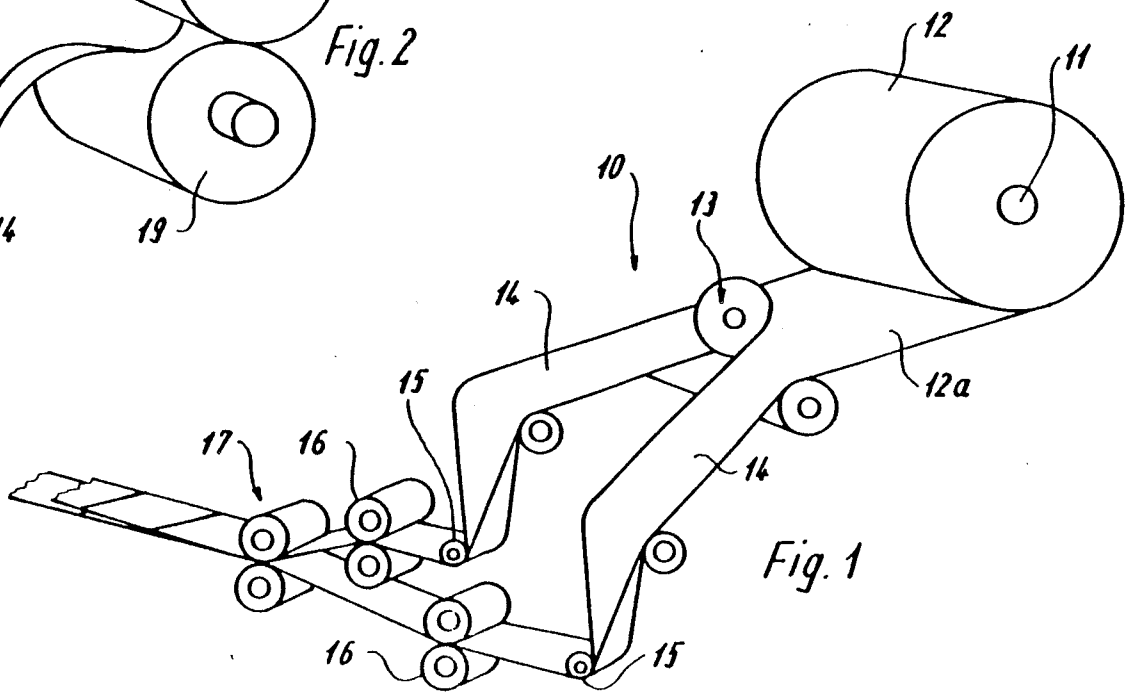
FIG. 1 is a schematic perspective view of an apparatus for cutting blanks from two superposed paper panels in accordance with a preferred embodiment of the invention.

FIG. 1 shows a device for cutting blanks from crepe paper. The apparatus as a whole is designated at 10.

The invention provides a method for cutting blanks from an elastic paper, preferably crepe paper, in an economical manner from two superposed paper panels 14 in a common rotary cutter 17. According to the method, a single paper web 12*a*is drawn off a single supply roll 12 supported by a roller holder 11. Individual paper panels 14 are formed by longitudinally cutting the panel 12*a* and bringing the two individual panels 14 together and cutting them alternatingly in the rotary cutter 17 from each side of the superposed paper panels 14.

With such an alternating cut in the rotary cutter 17, panel tension problems are avoided in the individual paper panels 14. The use of a single supply roll 12 is of advantage vantage from a manufacturing point of view compared to the use of a plurality of individual supply rolls.

The supply device 10 comprises a roll holder 11 for the mother roll 12, a cutter 13 for longitudinally cutting the panel 12*a* removed from the mother roll 12 into two separate paper panels 14, two folding stations 15 for folding each panel 14 lengthwise, two embossing stations 16 for providing delimitation lines for the blank in the region of the foldedtogether paper panels 14 and the rotary cutter 17 in which the two folded, embossed paper panels 14 are brought together in a superposed relationship and cut.

Figure 2:
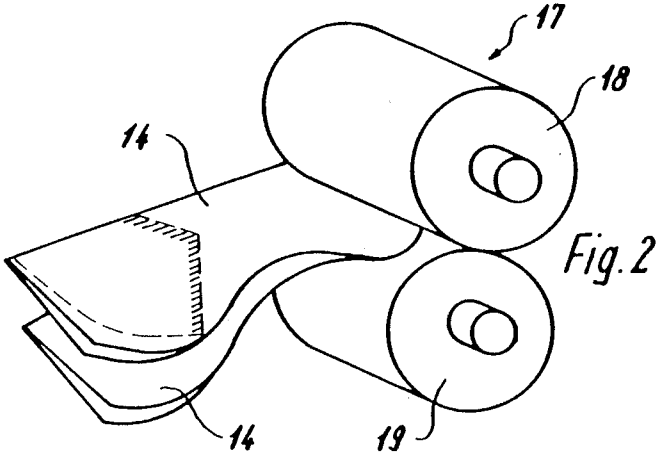
FIG. 2 is a schematic perspective view of a rotary cutter forming part of the apparatus of FIG. 1 in accordance with the invention.
Figures 3, 3A, 3B:
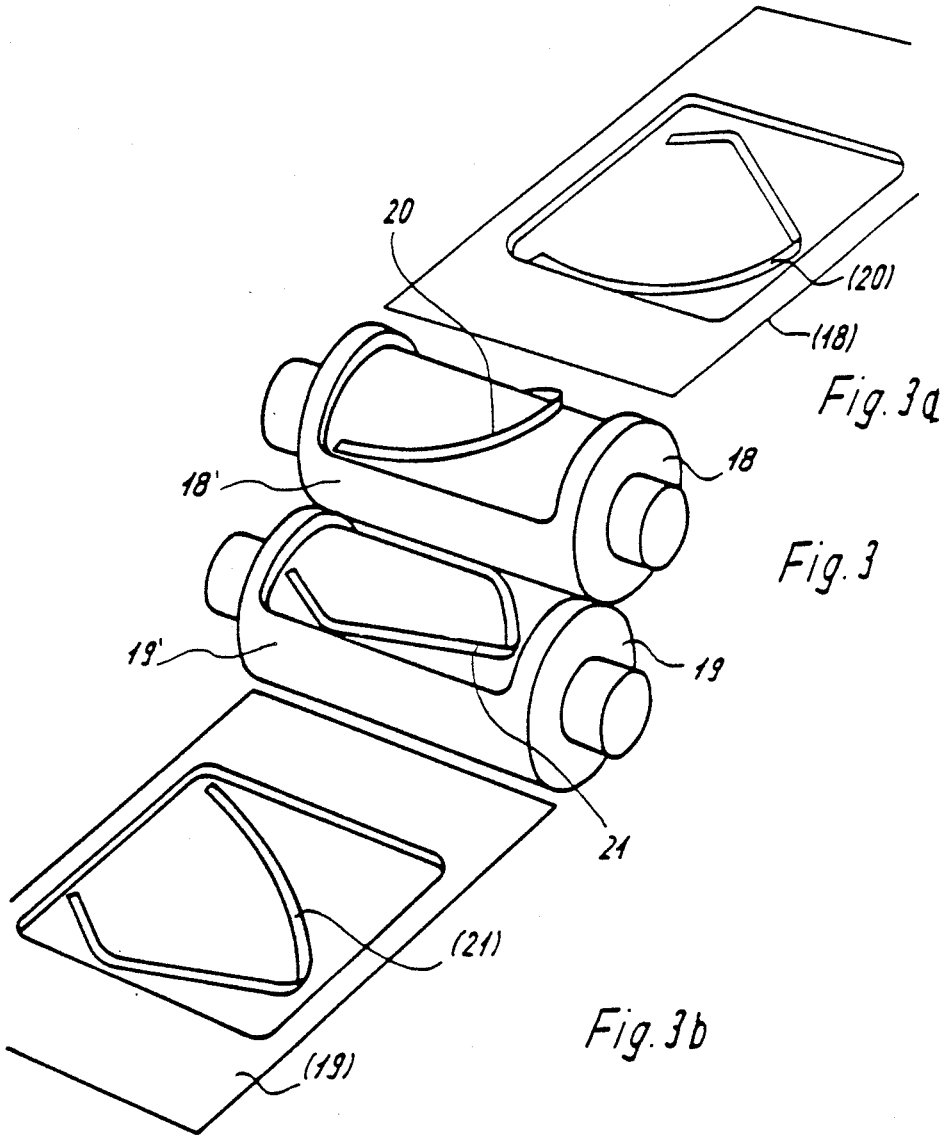
FIG. 3 is a schematic perspective view of two rollers of the rotary cutter in accordance with the invention.
FIGS. 3*a* and 3*b* are perspective views of developments of the surfaces of the respective rollers of FIG. 3.
Figure 4:
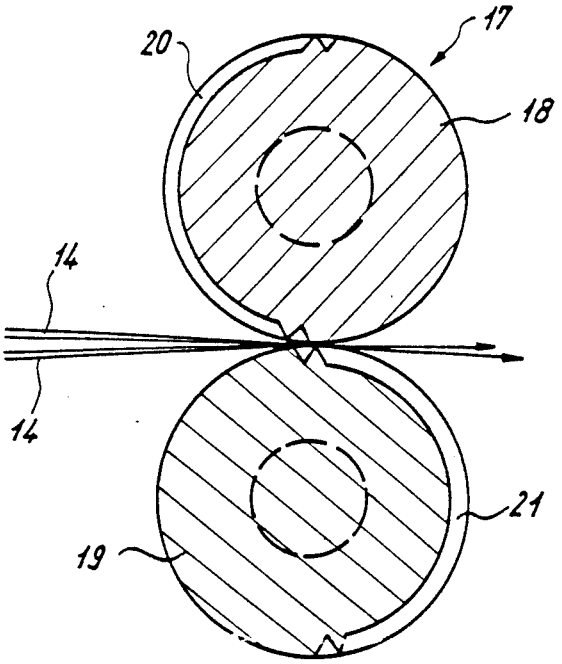
FIG. 4 is a sectional side elevational view of FIG. 2.

Also referring to FIGS. 2, 3 and 4, the rotary cutter 17 includes two rollers 18 and 19, each equipped with a cutting blade 20 and 21, respectively, which extend only over approximately one-half of the circumference of the respective rollers 18 and 19. Expediently, the circumferential length of the roller zone where the cutting blades are provided is an even number fraction (for example, ½, ¼, etc.) of the roller circumference. The cutting blades 20 and 21 of the two rollers 18 and 19 are offset with respect to one another when seen in the circumferential direction. Those surface portions 18', 19' of the rollers 18, 19 which are free from the respective cutting blades 20, 21 function as counterrollers for the regions of the respective other roller equipped with cutting blades. The two rollers 18 and 19 are configured in a known manner—for example, at opposite marginal circumferential portions—as transporting rollers for advancing the superposed webs.

As may be particularly well observed in FIG. 4, the two superposed paper panels 14 are alternatingly cut from both sides of the superposed paper panels 14 by the rotary cutter 17.

Figure 5:
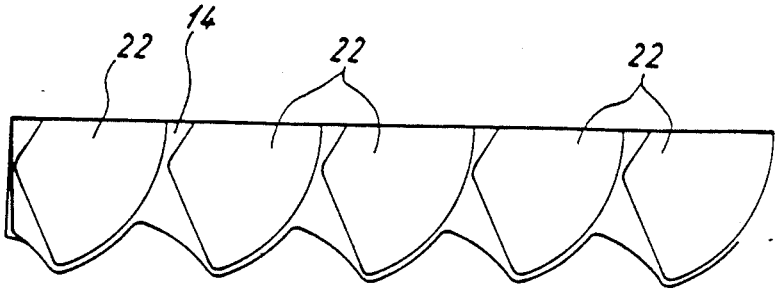
FIG. 5 is a top plan view of the superposed paper panels to be cut out.

Also referring to FIGS. 3*a*and 3*b*, which show developments of the surfaces of the respective rollers 18 and 19, if blanks 22 which have no axis of symmetry perpendicular to the transporting direction of the two paper panels 14 are to be cut from the paper panels 14, the two cutting blades 20 and 21 of the two rollers 18 and 19 are configured to be mirror images so that the cut blank is always the same, regardless of whether roller 18 or roller 19 is cutting. Such a configuration is necessary, for example, when, as in the illustrated embodiment, blanks 22 are to have a generally trapezoidal shape (to be bent in use into a funnel-shaped configuration), as shown in FIG. 5. To obtain such a blank configuration, it is expedient to employ a cutter 13*a* as shown in FIG. 6 to longitudinally cut the mother roll panels 12*a*.

The rotary blades 23 of the cutter 13*a* have a wavy shape—when seen in the circumferential direction—so that the paper panels 14 are cut in a wavy line. This wavy configuration permits an efficient (low-waste) arrangement of the individual blanks in an overlapping relationship in the longitudinal direction.

Figure 6:
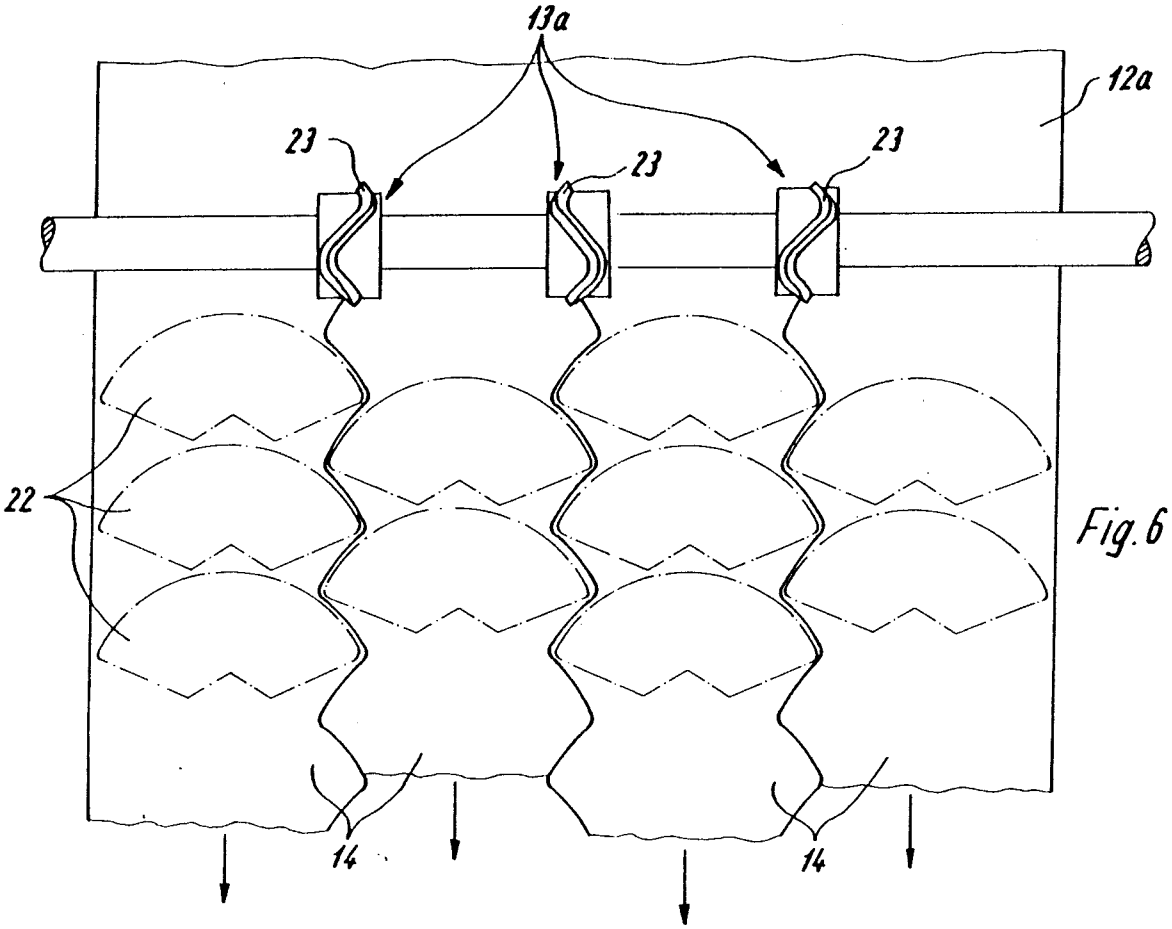
FIG. 6 is a schematic top plan view of a cutter according to another preferred embodiment of the invention.

The wave-shaped cut paper panels 14 shown in FIG. 6 are each folded in a known manner along their longitudinal center line in the folding stations 15 and are subsequently provided with stamped (embossed) seams in the embossing stations 16 which form a side seam and a bottom seam in the finished funnel-shaped bag to be produced. The folded edge of the folded-together paper panels 14 forms a further side edge of the finished bag blank.

After the stamping (embossing) step, the two folded and stamped paper panels 14 are brought together into a superposed relationship and are introduced into the rotary cutter 17 where the alternating cut of the paper panels 14 is performed which results in a constant equalization of the panel tension unavoidably generated during the cutting process.

The present disclosure relates to subject matter contained in Federal Republic of Germany Patent Application No. P 37 28 888 filed Aug. 29th, 1987, which is incorporated herein by reference.

It will be understood that the above description of the present invention is susceptible to various modifications, changes and adaptations and the same are intended to be comprehended within the meaning and range of equivalents of the appended claims.

What is claimed is:

1. A method of cutting blanks from an elastic paper, comprising the steps of (a) removing a single elastic paper web of indefinite length from a mother roll;

(b) longitudinally cutting the single web, as it runs off the mother roll, into a plurality of paper panels;

(c) guiding the running paper panels in pairs into a superposed, face-to-face relationship to form at least one running superposed paper panel pair;

(d) guiding the running paper panel pair between cooperating cutting rollers of a rotary cutter; each cutting roller having a cutting blade and a countersupporting surface; the cutting rollers being coordinated with one another such that at any time, the cutting blade of one of the cutting rollers is in engagement with the countersupporting surface of the other of said cutting rollers, whereby each cutting roller is, during operation, alterningly an active cutting roller and a non-cutting roller; and (e) cutting the blanks from the running paper panel pair by the cutting rollers alternatingly from opposite sides of the paper panel pair while countersupporting the paper panel pair by the momentarily non-cutting cutting roller.

2. A method as defined in claim 1, further comprising the steps of individually longitudinally folding each running paper panel prior to performing step (c) thereon.

3. A method as defined in claim 2, further comprising the step of providing a longitudinal seam on each running paper panel subsequent to the folding step.

4. A method as defined in claim 1, wherein step (b) comprises the step of cutting the single web into said plurality of paper panels in wavy longitudinal lines.

5. An apparatus for cutting blanks from an elastic paper, comprising (a) means for advancing a single elastic paper web of indefinite length;

(b) means for longitudinally cutting the single web, during advance thereof, into a plurality of paper panels;

(c) means for guiding the running paper panels in pairs into a superposed, face-to-face relationship to form at least one running superposed paper panel pair; and (d) two cooperating rotary cutting rollers between which the paper panel pair is introduced; each cutting roller having (1) a generally cylindrical surface formed of a first and a second circumferential surface portion; the second circumferential surface portion of each said cutting roller constituting a countersupporting surface; and (2) a cutting blade carried on the first circumferential surface portion of each said cutting roller; rotary positions of the two cutting rollers being coordinated with one another such that the paper panel pair passing between the rollers is alternatingly cut by the cutting blade of the one or the other cutting roller and is simultaneously countersupported by the countersupporting surface of a respective said cutting roller, whereby the blanks are cut alternatingly from the one and the other paper panel forming the paper panel pair.

6. A rotary cutter as defined in claim 5, wherein the cutting blades of the two cutting rollers are arranged in a mirror image relative to one another.

7. A rotary cutter as defined in claim 5, wherein each said cutting roller has a circumference and further wherein in each said cutting roller the circumferential length of the first circumferential surface portion is an even number fraction of said circumference.

8. A rotary cutter as defined in claim 5, wherein axially opposite marginal circumferential portions of the cutting rollers are conveying surfaces cooperating with one another for advancing the paper web.

* * * * *